US012553329B2

(12) United States Patent
Odi et al.

(10) Patent No.: US 12,553,329 B2
(45) Date of Patent: Feb. 17, 2026

(54) AUTOMATED DECLINE CURVE AND PRODUCTION ANALYSIS USING AUTOMATED PRODUCTION SEGMENTATION, EMPIRICAL MODELING, AND ARTIFICIAL INTELLIGENCE

(71) Applicant: Saudi Arabian Oil Company, Dhahran (SA)

(72) Inventors: Uchenna Odi, Houston, TX (US); Karri Srinivasa Reddy, Dhahran (SA); Cenk Temizel, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 1007 days.

(21) Appl. No.: 17/698,925

(22) Filed: Mar. 18, 2022

(65) Prior Publication Data

US 2023/0296011 A1 Sep. 21, 2023

(51) Int. Cl.
*E21B 44/00* (2006.01)

(52) U.S. Cl.
CPC ..... *E21B 44/00* (2013.01); *E21B 2200/20* (2020.05); *E21B 2200/22* (2020.05)

(58) Field of Classification Search
CPC ... E21B 44/00; E21B 2200/20; E21B 2200/22
See application file for complete search history.

(56) References Cited

U.S. PATENT DOCUMENTS

| | | | |
|---|---|---|---|
| 4,113,011 | A | 9/1978 | Bernard et al. |
| 4,665,981 | A | 5/1987 | Hayatdavoudi |
| 4,676,313 | A | 6/1987 | Rinaldi |
| 4,828,032 | A | 5/1989 | Teletzke et al. |

(Continued)

FOREIGN PATENT DOCUMENTS

| | | |
|---|---|---|
| CA | 2856274 | 5/2016 |
| WO | WO 199850680 | 11/1998 |

(Continued)

OTHER PUBLICATIONS

Tadjer et al., "Machine Learning Based Decline Curve Analysis for Short Term Oil Production Forecast", 2021, Department of Energy, Energy Exploration and Exploitation, Vo. 39(5), 1747-1769.*

(Continued)

*Primary Examiner* — Rehana Perveen
(74) *Attorney, Agent, or Firm* — Fish & Richardson P.C.

(57) ABSTRACT

A computer-implemented method for automated decline curve and production analysis using automated production segmentation, empirical modeling, and artificial intelligence. The method includes segmenting historical production data based on a change in a central tendency of a selected segmentation parameter to generate segmented production data. The method also includes forecasting future production data from a last production segment to a terminal decline rate according to a fitted empirical model, a trained artificial intelligence model, or any combinations thereof. The method includes forecasting exponential production data to an economic limit. Further, the method includes calculating an estimated ultimate recovery by summing the historical production data, future production data, and the exponential production data.

15 Claims, 7 Drawing Sheets

(56) References Cited

U.S. PATENT DOCUMENTS 5,794,316 A 8/1998 Anscher
5,854,991 A 12/1998 Gupta et al.
6,691,037 B1 2/2004 Poe et al.
7,082,993 B2 8/2006 Ayoub et al.
7,134,492 B2 11/2006 Willberg et al.
7,472,748 B2 1/2009 Gdanski et al.
7,716,028 B2 5/2010 Montaron et al.
7,777,606 B2 8/2010 Akbar et al.
7,819,181 B2 10/2010 Entov et al.
7,937,222 B2 5/2011 Donadille et al.
8,162,049 B2 4/2012 Rose
8,275,593 B2 9/2012 Zhao
8,498,852 B2 7/2013 Xu et al.
8,606,524 B2 12/2013 Soliman
8,731,889 B2 5/2014 Du et al.
8,803,077 B2 8/2014 Schmidt
9,075,038 B2 7/2015 Tumiatti et al.
9,187,984 B2 11/2015 Usadi et al.
9,470,086 B2 10/2016 Khalid et al.
9,710,766 B2 7/2017 Saleri et al.
9,732,592 B2 8/2017 Carvajal et al.
9,778,627 B2 10/2017 Stoettrup et al.
9,901,868 B2 2/2018 Salu et al.
9,910,938 B2 3/2018 Morales German et al.
9,934,295 B2 4/2018 Sarferaz
9,940,414 B2 4/2018 Ortiz et al.
9,946,974 B2 4/2018 Burch et al.
9,957,783 B2 5/2018 Gonzales et al.
9,994,118 B2 6/2018 Williams et al.
10,012,056 B1 * 7/2018 Lapierre ..... E21B 47/06
10,012,748 B2 7/2018 Gupta et al.
10,079,317 B2 9/2018 Gonatas
10,087,722 B2 10/2018 Lecerf et al.
10,125,586 B2 11/2018 Balan et al.
10,175,360 B2 1/2019 Zweigle et al.
10,240,098 B2 3/2019 Randhava et al.
10,254,432 B2 4/2019 Cuevas et al.
10,260,319 B2 4/2019 Sarduy et al.
10,267,132 B2 4/2019 Hoeink
10,288,041 B2 5/2019 Williams
10,301,918 B2 5/2019 Weng et al.
10,324,230 B2 6/2019 Kuchuk et al.
10,355,486 B2 7/2019 Pflaum et al.
10,360,783 B2 7/2019 Maher et al.
10,378,324 B2 8/2019 Conn et al.
10,378,344 B2 8/2019 Al-Dosary et al.
10,380,524 B1 8/2019 Raymond et al.
10,409,925 B1 9/2019 Hoff
10,415,354 B2 9/2019 Chidiac et al.
10,418,595 B2 9/2019 Li
10,436,940 B2 10/2019 Maucec et al.
10,443,359 B2 10/2019 DeValve et al.
10,445,669 B2 10/2019 Wessling et al.
10,450,841 B2 10/2019 Fulford
10,495,589 B2 12/2019 Kwak et al.
10,508,520 B2 12/2019 Saleri et al.
10,508,532 B1 12/2019 Mondal et al.
10,519,759 B2 12/2019 Klie
10,526,890 B2 1/2020 Batmaz et al.
10,534,961 B2 1/2020 Rostand et al.
10,541,374 B2 1/2020 Li
10,563,493 B2 2/2020 Ganguly et al.
10,599,747 B1 3/2020 Hoff
10,614,414 B1 4/2020 Raymond
10,634,815 B1 4/2020 Lapierre
10,655,442 B2 5/2020 Lecerf et al.
10,665,796 B2 5/2020 Li
10,670,753 B2 6/2020 De Matos Ravanelli et al.
10,718,208 B2 7/2020 Chorn
10,738,599 B2 8/2020 Babin et al.
10,740,512 B2 8/2020 Hoff
10,760,416 B2 9/2020 Weng et al.
10,788,604 B2 9/2020 Garcia-Teijeiro et al.
10,804,702 B2 10/2020 Claessens et al.
10,859,725 B2 12/2020 Dupont et al.
2003/0071988 A1 4/2003 Smith et al.
2007/0179767 A1 8/2007 Cullick et al.
2007/0272407 A1 11/2007 Lehman et al.
2008/0091396 A1 4/2008 Kennon et al.
2009/0020284 A1 1/2009 Graf et al.
2009/0065253 A1 3/2009 Suarez-Rivera et al.
2009/0164188 A1 6/2009 Habashy et al.
2010/0198570 A1 8/2010 Sarma et al.
2010/0256964 A1 10/2010 Lee et al.
2010/0300684 A1 12/2010 Kotsonis et al.
2011/0042083 A1 2/2011 Sierra et al.
2012/0016649 A1 1/2012 Thambynayagam et al.
2012/0239363 A1 9/2012 Durrani et al.
2012/0318500 A1 12/2012 Urbancic et al.
2013/0087328 A1 4/2013 Maida, Jr. et al.
2013/0096899 A1 4/2013 Usadi et al.
2013/0231910 A1 9/2013 Kumar et al.
2013/0332132 A1 12/2013 Mongalvy et al.
2014/0067353 A1 3/2014 Shelley et al.
2014/0083687 A1 3/2014 Poe et al.
2014/0172382 A1 6/2014 Andrews et al.
2014/0180658 A1 6/2014 Rossi et al.
2014/0297235 A1 10/2014 Arora et al.
2015/0370934 A1 12/2015 Pride et al.
2016/0042272 A1 2/2016 Mohaghegh
2016/0138371 A1 5/2016 Loaiza et al.
2016/0282881 A1 9/2016 Filippov et al.
2016/0356125 A1 12/2016 Bello et al.
2017/0045636 A1 2/2017 Ma et al.
2017/0074770 A1 3/2017 Fourno et al.
2017/0075001 A1 3/2017 McColpin et al.
2017/0145793 A1 5/2017 Ounes
2017/0191348 A1 7/2017 Al-Thawad et al.
2018/0230782 A1 8/2018 Pankaj et al.
2019/0219558 A1 7/2019 Villar De Andrade E Silva et al.
2019/0249534 A1 8/2019 Hoeink et al.
2019/0292881 A1 9/2019 Zhang et al.
2019/0332960 A1 10/2019 Zheng et al.
2019/0339709 A1 * 11/2019 Tay ..... G06F 16/23
2020/0174149 A1 * 6/2020 Thiruvenkatanathan ..... G01V 1/282
2020/0257932 A1 * 8/2020 Roberts ..... G06Q 50/02
2021/0087925 A1 * 3/2021 Heidari ..... G06N 20/00
2021/0095563 A1 4/2021 Gupta
2021/0124087 A1 4/2021 Liu et al.
2021/0349226 A1 * 11/2021 Alwehaibi ..... G01V 1/282
2021/0375248 A1 * 12/2021 Bonada ..... G06N 20/00
2021/0397994 A1 * 12/2021 Cerrahoglu ..... E21B 47/00
2022/0049589 A1 2/2022 Kibodeaux et al.

FOREIGN PATENT DOCUMENTS

WO WO 2001080043 10/2001
WO WO 2006059057 6/2006
WO WO 2014144917 9/2014
WO WO 2015016932 2/2015
WO WO 2015167935 11/2015
WO WO 2017041074 3/2017
WO WO 2019217131 11/2019
WO WO-2019221717 A1 * 11/2019 ..... E21B 41/00
WO WO 2020040829 2/2020
WO WO 2020112141 6/2020

OTHER PUBLICATIONS

U.S. Appl. No. 17/328,735, filed May 24, 2021, Aly et al.
U.S. Appl. No. 17/546,495, filed Dec. 9, 2021, Basri et al.
U.S. Appl. No. 17/577,463, filed Jan. 18, 2022, Temizel.
Alcorn et al., "An Integrated Carbon-Dioxide-Foam Enhanced-Oil-Recovery Pilot Program With Combined Carbon Capture, Utilization, and Storage in an Onshore Texas Heterogeneous Carbonate Field," SPE Reservoir Engineering, Nov. 2019, 22:04 (1449-1466), 18 pages.
Ali et al., "Constraining Interwell Water Flood Imaging with Geology and Petrophysics: An Example from the Middle East," SPE 120558, Paper presented at the 2009 SPE Middle East Oil & Gas Show and Conference, Bahrain, Mar. 15-18, 2009, 11 pages.

(56) References Cited

OTHER PUBLICATIONS

Alkhatib et al., "Robust Quantification of Uncertainty in Heterogeneity for Chemical EOR Processes: Applying the Multi-Level Monte Carlo Method," Paper presented at the SPE Middle East Oil & Gas Show and Conference, Bahrain, Mar. 8-11, 2015; 13 pages.
Anderson et al., "Petroleum Analytics Learning Machine to Forecast Production in the Wet Gas Marcellus Shale," URTeC 2426612, Unconventional Resources Technology Conference (URTeC), Fueled by SPE, AAPG, SEG, presented at the Unconventional Resources Technology Conference in San Antonio, Texas, USA, Aug. 1-3, 2016, 17 pages.
Anderson et al., "Probabilistic Forecasting of Unconventional Resources Using Rate Transient Analysis: Case Studies," SPE 155737, Society of Petroleum Engineers (SPE), presented at the Americas Unconventional Resources held in Pittsburgh, Pennsylvania, USA, Jun. 5-7, 2012, 16 pages.
Anderson, "Wettability literature survey—Part 2: Wettability measurement," Journal of Petroleum Technology, 38(11):, Nov. 1986, 1246-1262, 17 pages.
Artun et al., "Characterizing reservoir connectivity and forecasting waterflood performance using data-driven and reduced-physics models," SPE Western Regional Meeting, May 2016, 27 pages.
Asquith, "Reservoir Producibility Index (RPI) from NMR Logs and The Analysis of Tight Oil Reservoirs," URTeC 2673849, Unconventional Resources Technology Conference (URTeC), Fueled by SPE, AAPG, SEG, presented at the Unconventional Resources Technology Conference in Austin, Teas, Jul. 24-26, 2017, 5 pages.
Cao et al., "Data Driven Production Forecasting Using Machine Learning," SPE 180984-MS, Society of Petroleum Engineers (SPE), presented at the SPE Argentina Exploration and Production of Unconventional Resources Symposium held in Buenos Aires, Argentina, Jun. 1, 2016, 10 pages.
Chen et al., "Prediction of Sweet Spots in Shale Reservoir Based on Geophysical Well Logging and 3D Seismic Data," Energy Exploration and Exploitation, Mar. 2017, 35:2 (147-171), 26 pages.
Chou et al., "CO2 Foam Field Trial at North Ward-Estes," SPE 24643, Society of Petroleum Engineers (SPE), presented at the Society of Petroleum Engineers Annual Technical Conference, Washington, D.C. 1992, 12 pages.
Clarkson and Williams-Kovacs, "Modeling Two-Phase Flowback of Multifractured Horizontal Wells Completed in Shale," SPE 162593, Society of Petroleum Engineers (SPE), presented at the SPE Canada Unconventional Resources Conference, Calgary, Oct. 30-Nov. 1, 2012, 18 pages.
Clarkson et al., "Integration of microseismic and other post-fracture surveillance with production analysis: A tight gas study," Journal of Natural Gas Science and Engineering, vol. 3, No. 2, Mar. 25, 2011, 20 pages.
Creemer et al., "Efficient Use Of High Frequency Data Through Production Data Management System Implementation," SPE Intelligent Energy International, Ultrecht, The Netherlands, Mar. 27-29, 2021; SPE 150214, Jan. 2012, 12 pages.
Giles, "Multilevel Monte Carlo path simulation," Operations Research, 56(3), May-Jun. 2008, 607-617, 11 pages.
Hafidz Arief et al., "Real Time Reservoir Fluid Log from Advanced Mud Gas Data," SPE Annual Technical Conference & Exhibition, Oct. 2020, 14 pages.
Heller et al., "Testing CO2-Foam for Mobility Control at Rock Creek," SPE 14519, Society of Petroleum Engineers (SPE), presented at the Society of Petroleum Engineers Eastern Regional Meeting, Morgantown, West Virginia 1985, 14 pages.
Henry et al., "Field Test of Foam to Reduce CO2 Cycling," SPE 35402, Society of Petroleum Engineers (SPE), presented at the Society of Petroleum Engineers/Department of Energy Symposium on Improved Oil Recovery, Tulsa, Oklahoma 1996, 6 pages.
Hoefner and Evans, "CO2 Foam: Results from Four Developmental Field Trials," SPE Reservoir Engineering, Nov. 1995, 9 pages.
Ihsenergy.ca [online], "Harmony Enterprise Software, 2020.2," retrieved from URL <https://www.ihsenergy.ca/support/documentation_ca/Harmony_Enterprise/2020_2/content/html_files/start_here.htm>, Oct. 13, 2020, 2 pages.
Jiang et al., "Evaluating Producible Hydrocarbons and Reservoir Quality in Organic Shae Reservoirs using Nuclear Resonance (NMR) Factor analysis," SPE 175893-MS, Society of Petroleum Engineers (SPE), presented at the SPE/CSUR Unconventional Resources Conference in Calgary, Alberta, Canada, Oct. 20-22, 2015, 9 pages.
Jonas et al., "Evaluation of a CO2 Foam Field Trial: Rangely Weber Sand Unit," SPE 20468, Society of Petroleum Engineers (SPE), presented at the Society of Petroleum Engineers Annual Technical Conference, New Orleans, Louisiana 1990, 14 pages.
Kamari et al., "Effects of rock pore sizes on the PVT properties of oil and gas-condensates in shale and tight reservoirs," Petroleum, Jan. 10, 2018, 10 pages.
Kausik et al., "Novel Reservoir Quality Indices for Tight Oil," SPE 178622-MS, URTeC 2154859, Society of Petroleum Engineers (SPE), Unconventional Resources Technology Conference (URTeC), Fueled by SPE, AAPG, SEG, presented at the Unconventional Resources Technology Conference in San Antonio, Texas, US, Jul. 20-22, 2015, 10 pages.
Kunz et al., "The GERG-2008 Wide-Range Equation of State for Natural Gases and Other Mixtures: An Expansion of GERG-2004," J. Chem. Eng. Data 57 : pp. 3032-3091, 2004, 60 pages.
Lemmon et al., "NIST Standard Reference Database 23: Reference Fluid Thermodynamic and Transport Properties—REFPROP," Version 9.1, National Institute of Standards and Technology, Standard Reference Data Program, Gaithersburg, 2013, 62 pages.
Lertliangchai et al., "A Comparative Analysis of the Prediction of Gas Condensate Dew Point Pressure Using Advanced Machine Learning Algorithms," SPE Annual Technical Conference and Exhibition, Dubai, UAE, Sep. 21-23, 2021, SPE 205997-MS, 16 pages.
Li et al., "A Comparative Study of the Probabilistic-Collocation and Experimental-Design Methods for Petroleum-Reservoir Uncertainty Quantification," SPE Journal, 16(2), Jun. 2011, 429-439, 11 pages.
Liang et al., "Crosswell Electromagnetic Inversion Constrained by the Fluid-Flow Simulator," Paper presented at the SPE Annual Technical Conference and Exhibition, Florence, Italy, Sep. 19-22, 2010, 11 pages.
Mahmoud et al., "Practical Application of Type Curve Analysis to the Interpretation of Multi-Stage Fractured Horizontal Well Data," SPE-175931, Society of Petroleum Engineers (SPE), presented at the SPE/CSUR Unconventional Resources Conference held in Calgary, Alberta, Canada, 2015, 12 pages.
Marsala et al., "3D inversion practice for crosswell electromagnetic surveys in horizontal wells in Saudi Arabia," 85th Annual International Meeting, SEG, 2015, 4 pages.
Marsala et al., "Crosswell electromagnetic induction between two widely spaced horizontal wells: Coiled-tubing conveyed data collection and 3D inversion from a carbonate reservoir in Saudi Arabia," 85th Annual International Meeting, SEG, 2015, 4 pages.
Marsala et al., "Crosswell Electromagnetic Tomography: from Resistivity Mapping to Interwell Fluid Distribution," Paper presented at the International Petroleum Technology Conference in Kuala Lumpur (IPTC 12229), 2008; 6 pages.
Marsala et al., "First Borehole to Surface Electromagnetic Survey in KSA: Reservoir Mapping and Monitoring at a New Scale," Paper presented at the SPE Annual Technical Conference and Exhibition (SPE-146348), Denver, Colorado, Oct. 30-Nov. 2, 2011; 10 pages.
Marsala et al., "Fluid Distribution Inter-Well Mapping in Multiple Reservoirs by Innovative Borehole to Surface Electromagnetic: Survey Design and Field Acquisition," Paper presented at the International Petroleum Technology Conference (IPTC-17045), Beijing, China, Mar. 26-28, 2013; 4 pages.
Martin et al., "CO2-Foam Field Test at the East Vacuum Grayburg/San Andreas Unit," SPE Reservoir Engineering, Nov. 1995, 7 pages.
Microchip.com [online], "Harmony Enterprise Software V2," available on or before 2020, retrieved from URL <https://www.microchip.com/en-us/tools-resources/configure/mplab-harmony/version-2>, 6 pages.

(56) References Cited

OTHER PUBLICATIONS

Monger et al., "The Phase Behavior of CO2-Appalachian Oil Systems," SPE Annual Technical Conference and Exhibition, Oct. 1981, 11 pages.
Odi et al., "Decline Curve Analysis in Unconventional Reservoirs Using a Variable Power Law Model: A Barnett Shale Example," Unconventional Resources Technology Conference, Jul. 2019, 24 pages.
Odi et al., "Experimental Investigation of Wet Gas Dew Point Pressure Change With Carbon Dioxide Concentration," Abu Dhabi International Petroleum Conference and Exhibition, Nov. 2012, 19 pages.
Odi, "Optimal Process Design for Coupled CO2 Sequestration and Enhanced Gas Recovery in Carbonate Reservoirs," Thesis for the degree of Doctor of Philosophy, Texas A&M University, Dec. 2013, 241 pages.
Ogunyomi et al., "An Approach to Modeling Production Decline in Unconventional Reservoirs," Journal of Petroleum Exploration and Production Technology, Aug. 2017, 8(3):871-886, 16 pages.
Patil et al., "CO2 Foam Field Pilot Test in Sandstone Reservoir: Complete Analysis of Foam Pilot Response," SPE 190312, Society of Petroleum Engineers (SPE), presented at the Society of Petroleum Engineers Improved Oil Recovery Conference, Tulsa, 2018, 14 pages.
Patzek et al., "Gas production in the Barnett shale obeys a simple scaling theory," PNAS, Dec. 2013, 110:49 (19731-19736), 6 pages.
Piper et al., "Compressibility Factors for Naturally Occurring Petroleum Gases," SPE Annual Technical Conference and Exhibition, Oct. 1993, 11 pages.
Potsch et al., "A Novel Graphical Method for Determining Dewpoint Pressures of Gas Condensates," European Petroleum Conference, Oct. 1996, 3 pages.
Sanders et al., "Implementation of a CO2 Foam Pilot Study in the SACROC Field: Performance Evaluation," SPE 160016, Society of Petroleum Engineers (SPE), presented at the Society of Petroleum Engineers Annual Technical Conference, San Antonio, Texas 2012, 13 pages.
Sayarpour et al., "Field applications of capacitance-resistance models in waterfloods," SPE Res Eval & Eng., 12(6):, 2009, 853-864, 12 pages.
Shyeh et al., "Examples of Right-Time Decisions from High Frequency Data," SPE Intelligent Energy Conference and Exhibition, Feb. 2008, 14 pages.
Siddiqui et al., "Stability and Texture of CO2/N2Foam in Sandstone" Colloids and Surfaces A: Physiochemical and Engineering Aspects, vol. 534, May 24, 2017, 26-37, 12 pages.
Sivaraman et al., "Acoustic Dew Point and Bubble Point Detector for Gas Condensates and Reservoir Fluids," Annual Technical Meeting, Jun. 1997, 7 pages.
Solbakken, "Experimental Studies of N2- and CO2-Foam Properties in Relation to Enhanced Oil Recovery Applications," Ph.D. dissertation, University of Bergen, 2015, 353 pages.
Stephenson et al., "Mobility control experience in the Joffre Viking miscible CO2 flood." SPE Reservoir Engineering 8.03, Aug. 1993, 183-188, 6 pages.
Szabries et al. "Foam Analysis at Elevated Pressures for Enhanced Oil Recovery Applications" Energy & Fuels, vol. 33, No. 5, May 16, 2019, 10 pages.
Tatang et al., "An efficient method for parametric uncertainty analysis of numerical geophysical models," Journal of Geophysical Research, vol. 102, No. D18, Sep. 27, 1997; pp. 21,925-21,932, 8 pages.
Temizel et al., "Improving oil-rate estimate in capacitance/resistance modeling using the Y-function method for reservoirs under waterfloor," SPE Res Eval & Eng, 22(3):, Mar. 2019, 1161-1171, 11 pages.
Ter Heege et al., "Sweet Spot Identification in Underexplored Shales Using Multidisciplinary Reservoir Characterization and Key Performance Indicators: Example of the Posidonia Shale Formation in he Netherlands," Journal of Natural Gas Science and Engineering, 2015, 27: 558-577, 20 pages.
Valko et al., "Reservoir oil bubblepoint pressures revisited; solution gas-oil ratios and surface gas specific gravities," Journal of Petroleum Science and Engineering, Mar. 2003, 37(3-4):153-169, 17 pages.
Wagner et al, "International Equations for the Saturation Properties of Ordinary Water Substance. Revised According to the International Temperature Scale of 1990," Addendum to J. Phys. Chem. Ref. Data 16, 893 (1987), J. Phys. Chem. Ref, Data. 22, pp. 783-787, 5 pages.
Whitson et al., "Khuff Gas Condensate Development," International Petroleum Technology Conference, Nov. 2005, 19 pages.
Wikistat, "Neural networks and introduction to deep learning," 2017, retrieved from URL <https://www.math.univ-toulouse.fr/~besse/Wikistat/pdf/st-m-hdstat-rnn-deep-learning.pdf>, 17 pages.
Wilt et al., "Monitoring a Water Flood of Moderate Saturation Changes with Crosswell Electromagnetics (EM): A Case Study from Dom Joao Brazil," Paper presented at the SEG Las Vegas 2012 Annual Meeting, 2012, 4 pages.
Xue et al., "Optimal Transformations for Multiple Regression: Application to Permeability Estimation from Well Logs," SPE Form. Eval., Jun. 1997, 12(02):85-93, 9 pages.
Yang et al., "A Machine Learning Approach to Predict Gas Oil Ratio Based on Advanced Mud Gas Data," 81st EAGE Conference and Exhibition, Jun. 2019, 17 pages.
Yang et al., "Reservoir Fluid Data Acquisition Using Advanced Mud Logging Gas in Shale Reservoirs," SPE/AAPG/SEG Unconventional Resources Technology Conference, Jul. 2019, 17 pages.
Zeng et al., "Role of Gas Type on Foam Transport in Porous Media," Langmuir, 32, Jun. 2016, 6239-6245, 7 pages.
SAIP Examination Report in SAIP Appln. No. 123441415, mailed on Mar. 23, 2025, 11 pages, with English Translation.

* cited by examiner

AUTOMATED DECLINE CURVE AND PRODUCTION ANALYSIS USING AUTOMATED PRODUCTION SEGMENTATION, EMPIRICAL MODELING, AND ARTIFICIAL INTELLIGENCE

TECHNICAL FIELD

This disclosure relates generally to automated decline curve analysis.

BACKGROUND

Decline curve analysis (DCA) refers to a process of examining graphical representations of declining production rates of a well. Declines in production rates over time can be due to changing volumes of production fluids, a loss of reservoir pressure, and the like. Wells generally produce at a maximum rate near the beginning of operational life, and due to declining production rates are eventually no longer profitable.

SUMMARY

An embodiment described herein provides a method automated decline curve and production analysis using automated production segmentation, empirical modeling, and artificial intelligence. The method includes segmenting historical production data of a well based on a change in a central tendency of a segmentation parameter to generate segmented production data. The method also includes forecasting future production data from a last production segment to a terminal decline rate according to a fitted empirical model, a trained artificial intelligence model, or any combinations thereof. The method includes forecasting exponential production data to an economic limit. Further, the method includes calculating an estimated ultimate recovery of the well by summing the historical production data, future production data, and the exponential production data.

An embodiment described herein provides an apparatus comprising a non-transitory, computer readable, storage medium that stores instructions that, when executed by at least one processor, cause the at least one processor to perform operations. The operations include segmenting historical production data of a well based on a change in a central tendency of a segmentation parameter to generate segmented production data. The operations also include forecasting future production data from a last production segment to a terminal decline rate according to a fitted empirical model, a trained artificial intelligence model, or any combinations thereof. The operations include forecasting exponential production data to an economic limit. Further, the operations include calculating an estimated ultimate recovery of the well by summing the historical production data, future production data, and the exponential production data.

An embodiment described herein provides a system. The system comprises one or more memory modules and one or more hardware processors communicably coupled to the one or more memory modules. The one or more hardware processors is configured to execute instructions stored on the one or more memory models to perform operations. The operations include segmenting historical production data of a well based on a change in a central tendency of a segmentation parameter to generate segmented production data. The operations also include forecasting future production data from a last production segment to a terminal decline rate according to a fitted empirical model, a trained artificial intelligence model, or any combinations thereof. The operations include forecasting exponential production data to an economic limit. Further, the operations include calculating an estimated ultimate recovery of the well by summing the historical production data, future production data, and the exponential production data.

DETAILED DESCRIPTION

Figure 1:
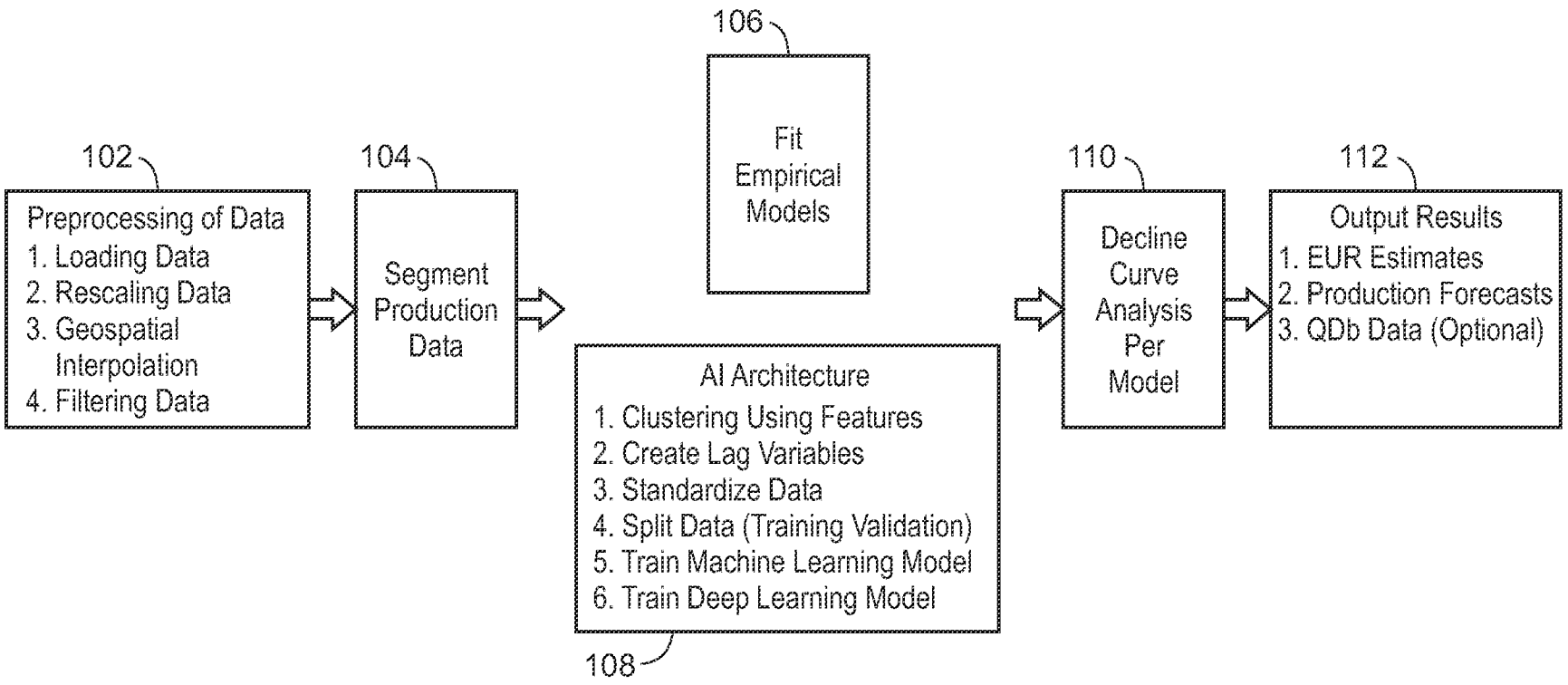
FIG. 1 is a workflow that enables automated decline curve and production analysis.

Embodiments described herein enable automated decline curve and production analysis. In particular, the present techniques use automated segmentation, empirical modeling, and artificial intelligence to automate decline curve analysis. In some embodiments, decline curve analysis (DCA) is used for rate prediction. The present techniques enable automation of decline curve analysis for the estimate of production forecasts and reserves from irregular production histories. Well level and subsurface features are incorporated into the decline curve analysis process for reserves determination by using artificial intelligence. In embodiments, production history that does not follow traditional production declines is segmented. A traditional production decline corresponds to production histories that begin with large production rates (as compared to the entire production history) followed by increasingly smaller rates in a substantially linear or quadratic form. With traditional production declines, a single equation can be fit using the production data, where the equation describes the physics defining the simple production decline. In some examples, regular production histories can be represented by a single equation. In contrast to this, a complex production history contains several individual declines and a single production trend or equation cannot be fit to the production history. The complex production history can be irregular, and lack a single equation to represent the multiple declines. In embodiments, these production declines are discovered automatically by observing previous well head pressures or the production rate over a specified windowed time. The present techniques automatically detect production anomalies caused by changes in pressure or sudden changes in the reservoir system. The production anomalies include reservoir fluid phase changes in the reservoir system, frack hits, and other subsurface phenomenon that results in a significant response in the well head pressure.

Traditional, manual decline curve analysis is a cumbersome task for a reservoir engineer, requiring individual analysis of a well's production history for the purpose of production forecasting and estimating reserves. When a reservoir engineer is responsible for several hundred wells and their corresponding analysis, this task can take substantial time, especially for production histories with frequent irregular production. In traditional, manual decline curve analysis, a user individually locates production declines in a hydrocarbon well's production history. Traditional decline curve analysis incorporates production volumes at daily, monthly, quarterly, or yearly intervals. The present techniques enable decline curve analysis to be executed on high frequency data sets comprising of less than a day sampling frequency, while also incorporating the influence of well-level and subsurface features such as temperature, pressure, and choke setting into the analysis using artificial intelligence. Traditional decline curve procedures are limited to production history as an input to determine reserves. In embodiments, the present techniques provide estimates of reserves as direct functions of temperature, pressure, choke, and production volumes.

FIG. 1 is an illustration of a workflow 100 that enables automated decline curve and production analysis. The workflow may be executed using the process 600 of FIG. 6, using the system 700 of FIG. 7.

At block 102, historical production data is preprocessed. Historical production data includes, for example, gas rates, oil rates, condensate rates, water rates, and the like. Preprocessing the historical production data includes loading data, rescaling data, geospatial interpretation, and filtering data. Loading data refers to the process of bringing production data into the workflow for analysis. In some embodiments, historical production data is up-scaled to a user defined interval. For example, the initial interval data representing noisy high frequency data may comprise production volumes sampled at every fifteen or thirty minutes. Up-scaling the historical production data determines production volume samples at longer time intervals. In an example, noisy, high frequency data from production volumes sampled at every fifteen or thirty minutes are up-scaled to samples that occur at longer time intervals. The longer time intervals may be, for example, sampling every three hours, six hours, twelve hours, and etc. By up-scaling the production volume samples, the effect of noise on the production analysis is minimized.

In embodiments, geospatial interpretation is applied to the historical production data. During geospatial interpolation, historical production data with coordinates (e.g., longitude and latitude data) are used to generate a model that predicts sample values in respective locations where no historical production data exists. In some examples, the predicted sample values are generated based on a relationship between the historical production data and the coordinates. In embodiments, the historical production data is filtered by removing unphysical data such as negative rates or values that are considered outliers. An outlier is a sample that deviates from the mean of the sample values by more than a predetermined number of standard deviations. In some examples, an outlier deviates from the mean of the sample values by more than three standard deviations At block 104, the preprocessed historical production data is segmented. A segmentation parameter is used to segment the preprocessed historical production data. A segmentation parameter is a parameter that impacts production over time. The segmentation parameter is a driver of production changes over time. In some examples, the well head pressure of the well is selected as a segmentation parameter and used to segment the preprocessed historical production data. In embodiments, pressure is selected as the segmentation parameter as it is the primary driver that dictates changes in the isothermal reservoir production system. In embodiments, a primary phase production rate is selected as a segmentation parameter. If the primary phase is gas and the production history is extensive, then a condensate gas ratio can be used as the primary means of segmentation.

Figure 2:
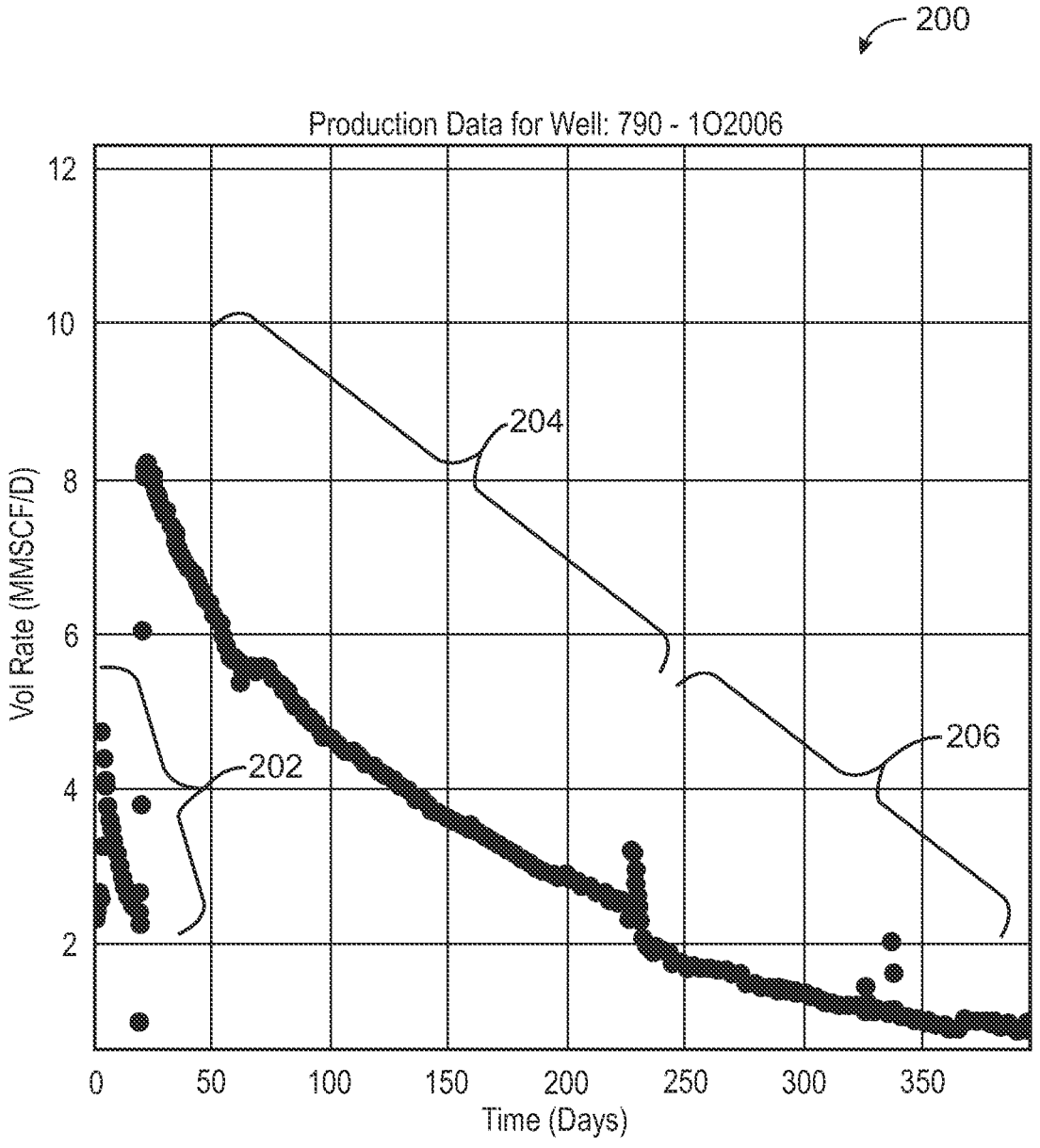
FIG. 2 is an illustration of up-scaled data of a single well.

Segmentation is initialized by determining a running window length. In embodiments, the running window length indicates a period of time for which decline curve analysis will be executed. In examples, the running window length is determined according to a period of time covered by the up-scaled historical production data. In examples, the up-scaled production data is stored in tabular form, with a row of production data as sampled at the up-scaled time interval. For example, four rows of data up-scaled to twelve hour intervals corresponds to a running window length of two days. FIG. 2 is an illustration of a graph 200 with up-scaled production data of a single well. In the example of FIG. 1, historical production data of the single well is up-scaled 12 hour intervals. The graph 200 shows several declines 202, 204, and 206 that would require individual analysis per decline.

Referring again to FIG. 1, calculations are performed on the up-scaled historical production data within the running window length. For ease of description, pressure is used as a segmentation parameter. However, any segmentation parameter can be used. The central tendency of the up-scaled pressure ($P_m$) is calculated. Central tendency may be the median, mean, or mode of the up-scaled pressure. In some embodiments, a central tendency of a distribution of pressures/phase production rate (e.g., the historical production data) is determined. Median is the value which occupies the middle position when all the samples are arranged in an ascending/descending order. Mode is the value that occurs most frequently in the samples. Some data sets do not have a mode because each value occurs only once. Mean is an average of the samples. The relative location of the mean, median, and mode as measures of a central tendency depends on the shape of the distribution. All three measures are identical in a normal distribution.

The central tendency is calculated across the window, with a running window length that extends from the beginning of the production history to the end, at a most recent timestamp. As this window moves, the central tendency is calculated using the span of the window. Once the central tendency is determined, the maximum of the central tendency ($P_{m,max}$) and the minimum of the central tendency ($P_{m,min}$) are calculated. The maximum of a central tendency is the largest calculated central tendency across all rows of data using the windowed approach. The minimum of a central tendency is the smallest calculated central tendency across all rows of data using the windowed approach. Additionally, percent change in the maximum ($\Delta P_{m,max}$) central tendency, percent change in the minimum ($\Delta P_{m,min}$) central tendency, and percent change in the up-scaled pressure ($\Delta P_{\%}$) are calculated.

The mean and standard deviation of the maximum percent change of the central tendency ($\overline{\Delta P_{m,max}}$ and $\sigma_{\Delta P_{m,max}}$ respectively) are calculated. Similarly, the mean and standard deviation of the minimum percent change of the central tendency ($\overline{\Delta P_{m,min}}$ and $\sigma_{\Delta P_{m,min}}$ respectively) are calculated. A maximum flagged pressure ($\Delta P_{flag,max}$) change is calculated using the following expression:

$$\Delta P_{flag,max}=\overline{\Delta P_{m,max}}+u_{stdv,max}\cdot\sigma_{\Delta P_{m,max}}$$

where $u_{stdv,max}$ is the maximum unit standard deviation indicative of an outlier.

A minimum flagged pressure ($P_{flag,min}$) change is calculated using the following expression:

$$\Delta P_{flag,min}=\overline{\Delta P_{m,min}}+u_{stdv,min}\cdot\sigma_{\Delta P_{m,min}}$$

where $u_{stdv,min}$ is the minimum unit standard deviation indicative of an outlier. In some examples, an outlier is a value more than three standard deviations away from the central tendency.

Figure 3:
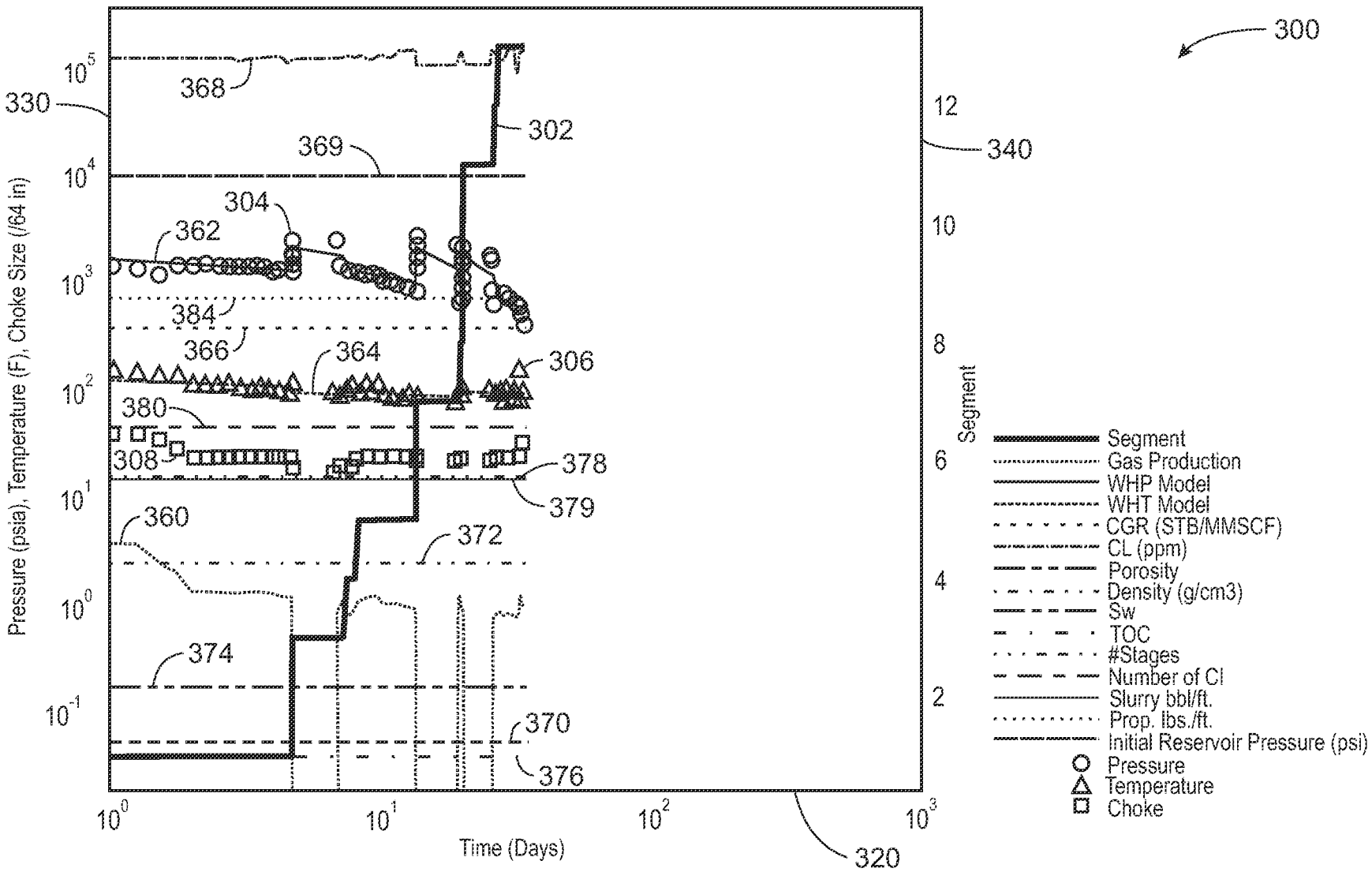
FIG. 3 is an illustration of automated segmentation of pressure profile and model fitting of temperature and pressure.

The historical production data is segmented by partitioning historical production data based on at least one flagged segmentation parameter change, wherein the central tendency outside of the flagged segmentation parameter change. Continuing with the example of pressure as a segmentation parameter, the historical production data is segmented using the calculated flagged pressure changes. For example, the production history is segmented where change in the maximum central tendency is larger than the maximum flagged pressure change, or the change in the minimum central tendency is larger than the minimum flagged pressure change. FIG. 3 is graph 300 that illustrates automated segmentation of production data.

In the example of FIG. 3, automated segmentation is based on pressure 304 as a segmentation parameter. Declines shown in FIG. 2 are segmented as illustrated in FIG. 3. Temperature 306 and pressure 304 were modeled using an empirical formulation. Time is plotted along x-axis 320, well head pressures are plotted along a first y-axis 330, and a number of segments for the windowed length of time is plotted long a second y-axis 340. The dual y-axes 330 and 340 illustrate the relationship between the well head pressures of the well and the number of segments over time. In the example of FIG. 3, some segments can be visualized according to a horizontal portion of line 302 that corresponds to the number of segments over time. The segments 302 are marked by a beginning timestamp and ending timestamp, during which a response of the well head pressure 304 is stable. Each segment corresponds to an individual instance of segmentation where there is no specific perturbation in the pressure response (i.e. pressure is stable for a segment without any large deviation within the segment). The perturbations in the pressure response 304 trigger the creation of a new segment, and are counted by the segmentation line 302.

Well head pressure 304 is illustrated with circles, temperature 306 is illustrated with triangles, and choke 308 is illustrated using squares. The model fitting of temperature and pressure are illustrated by a line going through the data for both temperature and pressure. The line corresponds to the best fit model used to fit pressure and temperature individually. Accordingly, the line 364 represents temperatures from a well head temperature (WHT) model. The line 362 represents pressures from a well head pressure (WHP) model. Other data associated with the single well is illustrated in the graph 300. Line 360 represents gas production, line 366 represents (CGR) 366, line 368 represents (CL), line 370 represents porosity, line 372 represents density, line 374 represents ($S_w$), line 376 represents (TOC), line 378 represents a number of stages, line 380 represents a number of CL, line 382 represents slurry, and line 384 represents prop. at an initial reservoir pressure.

Referring again to FIG. 1, after the segmentation of historical production data, each segment of production data is modeled using fitted empirical models, trained artificial intelligence models, or any combinations thereof. The present techniques enable the use of one or multiple models for decline curve analysis. In this manner, irregular declines are analyzed using the best fit model for each segment. In examples, decline curve analysis at block 110 is enabled via fitted empirical models, trained artificial intelligence models, or any combinations thereof.

In the example of FIG. 1, at block 106, empirical models are fit to the segmented production data. The fitted empirical model is generated by minimizing a difference between the segmented production data and predicted output of an empirical model. An error function determines a difference between the segmented production data and the predicted output of the empirical models. The parameters of the empirical models are selected to minimize this difference. For example, using empirical models, the best parameters ($\beta_0, \beta_1, \beta_2, \ldots \beta_n$) that reduce the square error between the production data (q) and empirical model represented by $f(\beta_0, \beta_1, \beta_2, \ldots \beta_n)$ for each production segment are determined. The fitting of empirical models minimizes $[q-f(\beta_0, \beta_1, \beta_2, \ldots \beta_n)]^2$ by changing $\beta_0, \beta_1, \beta_2, \ldots \beta_n$]. For example, a hyperbolic model is an empirical model that is a function of parameters Qi, Di, and b. To minimize the square error between the production data and the hyperbolic model, the combination of Qi, Di, and b is iteratively changed until the square error between the hyperbolic model and the production data is minimized. In the example of FIG. 1, decline curve analysis is executed using the fit empirical model at block 110. In some examples, a user selects automated decline curve analysis using empirical models via a graphical user interface (GUI). When empirical models are selected, the empirical model outputs the parameters describing the production decline through time for the selected empirical model, and the artificial intelligence models are not trained or used for decline curve analysis.

At block 108, the segmented production data is modeled using an artificial intelligence architecture. In examples, the AI architecture includes machine learning and deep learning models. The AI architecture is realized by clustering using features, creating lag variables, standardizing data, splitting data (training validation), training the machine learning model, and training the deep learning model. In embodiments, for an artificial intelligence model (represented by f(AI)), the architecture that reduces the square error between the production data (q) and machine learning or deep learning model for each production segment is selected. The selected AI model minimizes $[q-f(AI)]^2$ by changing hyper parameters of the machine learning or deep learning architecture.

In some examples, feature clustering divides the historical production data into groups by the features' characteristics, such as the mean, mode, median. Lag variables are created that correspond to using prior information. The lag variables contain data from prior timestamps and enable the forecasting of production volumes as time series data. To train the machine learning and deep learning models, segmented production data is split into a training dataset and a testing dataset. The division of segmented production data into a training dataset and a testing dataset is used to estimate the performance of the machine learning and deep learning models when used to make predictions on data not used to train the model. In examples, the segmented production data is divided such that eighty percent of the segmented production data is a training dataset, and twenty percent is a test set. The historical production data used for training contains the input features, lagged parameters, and cluster identification. In examples, placing these parameters in columns, if the data contains 100,000 rows of data and the data split is specified as 80% training and 20% test, then the number of rows in the training split is 80,000 and the number of rows in the test set is 20,000.

When artificial intelligence models are used, the segmented production data consists of pressure, temperature, choke, and other parameters that sufficiently model production volumes. In embodiments, the inputs to the machine learning models include, but are not limited to, the forecasted choke, pressure, temperature, and time. Hyper parameters of the artificial intelligence models are optimized until a misfit between artificial intelligence model and data the segmented production data is minimized. Decline curve analysis is executed using the trained artificial intelligence models at block 110. In some examples, a user selects automated decline curve analysis using artificial intelligence models via a GUI. When artificial intelligence models are selected, the artificial intelligence models are trained to predict the production decline over time. In some examples, the artificial intelligence models also output a standardization algorithm that normalizes the production data prior to input to the trained artificial intelligence models. Additionally, a lagging workflow is generated by the artificial intelligence models that enables the use of prior information as features into the machine and deep learning model. For example, consider a situation where a prediction is to be made for a production decline of a well on a Saturday, and production data exists for the prior Monday through Friday for the well. The existing production data from the previous days of Monday through Friday are prior information that is used to predict production and production declines on the following Saturday.

Figure 4:
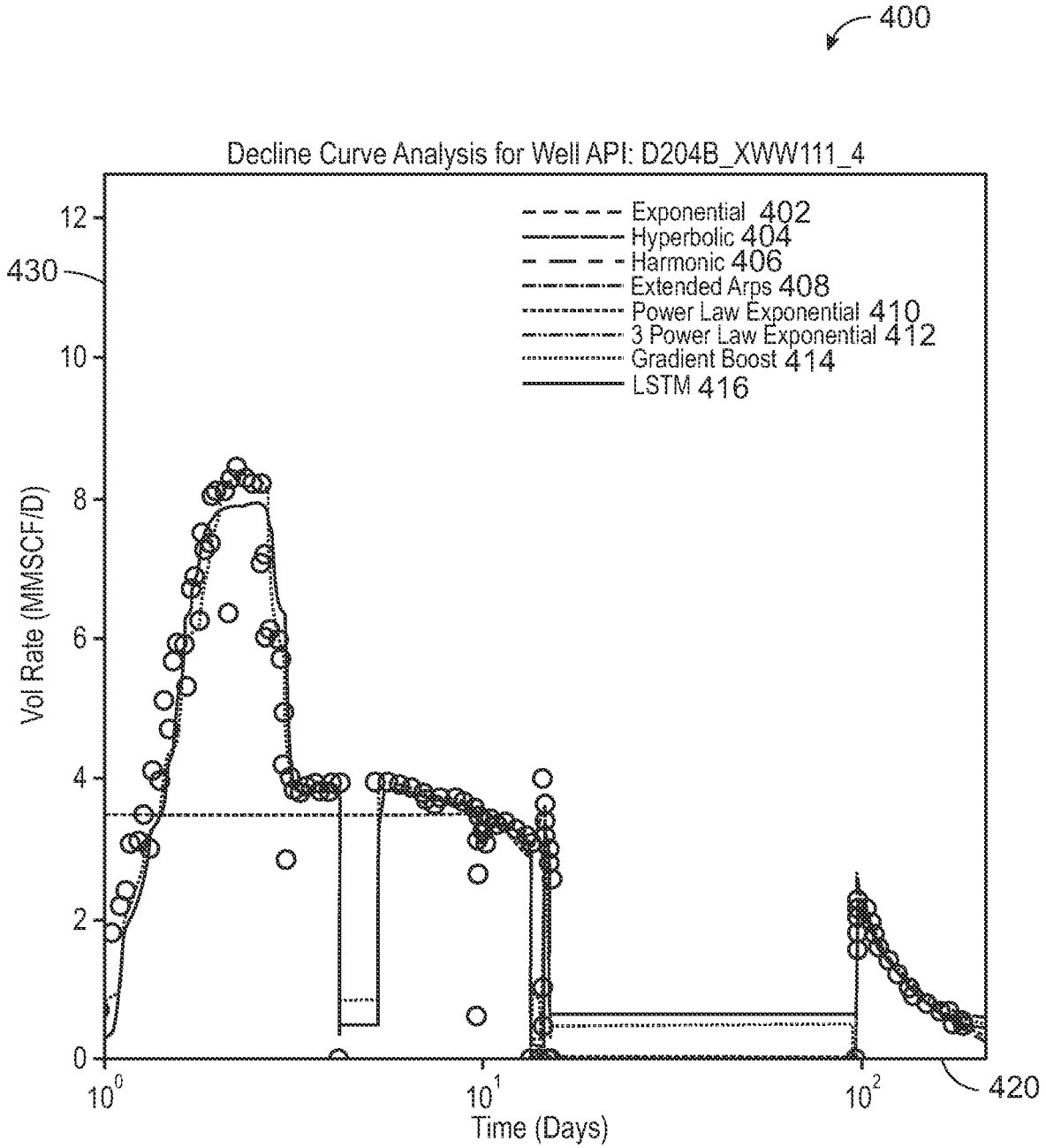
FIG. 4 is an illustration of automated curve fitting for each segment using empirical models.

At block 110, decline curve analysis is executed on a per model basis. For example, choke, temperature, and pressure are modeled as a function of time using empirical model or general observations. Using the developed models (e.g., the fit empirical model from block 106, a trained artificial intelligence model from block 108, or any combinations thereof), future production data is forecast beginning with a last production segment until a terminal decline rate. In examples, the last production segment is the segment with a most current timestamp in the segmented production data. The terminal decline rate is the late life decline rate observed in oil and gas wells. FIG. 4 is a graph 400 that illustrates automated curve fitting. Time is plotted along the x-axis 420 and production rates are plotted along the y-axis 430. In the example of FIG. 4, automated curve fitting is illustrated for each segment using empirical models (exponential 402, hyperbolic 404, harmonic 406, extended Arps 408, power law exponential 410, and Power Law Exponential (n=3) 412, modeling using artificial intelligence (gradient boost 414 and long short-term memory (LSTM) 416), and decline curve analysis. In FIG. 4, despite a lack of traditional production declines, the gradient boost model 414 and the long short-term memory LTSM model 416 accurately model production.

Referring again to FIG. 1, after a terminal decline rate, an exponential model is used to forecast exponential production data to an economic limit. In examples, the terminal decline rate is the rate at which the hyperbolic decline switches from hyperbolic to exponential decline. The equation for exponential production decline is as follows:

$$q=Q_i^*\exp(-D_i^*\text{time})$$

Additionally, the economic limit refers to the minimum oil or gas rate that makes the cumulative net operating cash flow (net revenue subtracted from operating cost) greater than or equal to zero.

Figure 5:
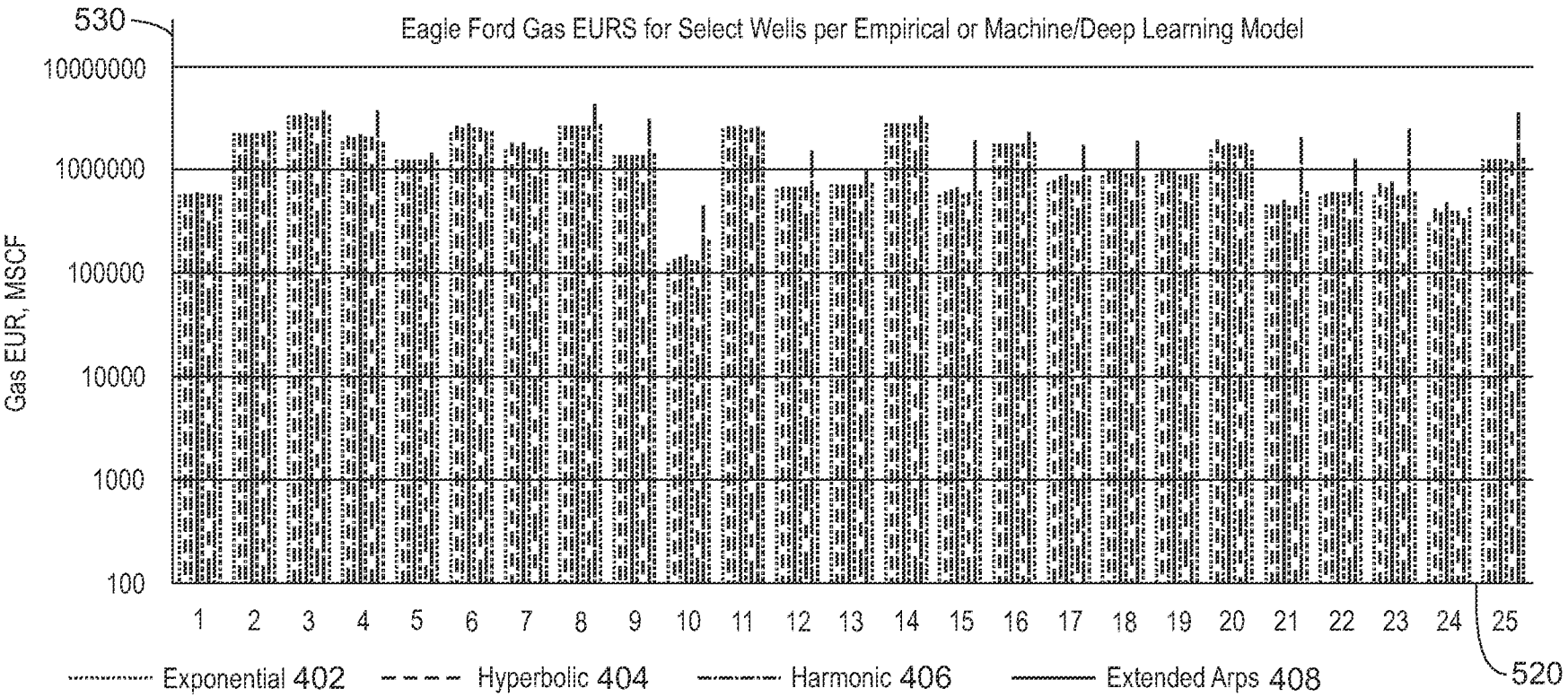
FIG. 5 is an illustration of estimated ultimate recoveries per various models.

At block 112, results are output. The results can include, for example, estimated ultimate recovery (EUR), production forecasts, QDb data, or any combinations thereof. FIG. 5 is a graph 500 that illustrates estimated ultimate recoveries 530 for a number of wells 520. The following models are illustrated: Empirical (exponential 406, hyperbolic 404, harmonic 406, extended Arps 408, power law exponential 410, and Power Law Exponential (n=3) 412; and using artificial intelligence (Gradient Boost 414 and LSTM 416). In the example of FIG. 5, the illustrated estimated ultimate recovery corresponds to a test of workflow on more than 2600 wells.

Referring again to FIG. 1, in examples, the estimated ultimate recovery is the sum of volumes produced from production history, from forecasting using empirical or artificial intelligence models, and from forecasting using an exponential model to the economic limit. In some examples, production data (Q), decline rate data (D), and b value data (b) is output. This QDb data are typically plotted on a log-log plot, and the corresponding information can be used to determine the best decline curve model. QDb can be calculated using several algorithms.

The block diagram of FIG. 1 is not intended to indicate that the workflow 100 is to include all of the components shown in FIG. 1. Rather, the workflow 100 can include fewer or additional components not illustrated in FIG. 1 (for example, additional models, additional preprocessing, and the like). The workflow 100 may include any number of additional components not shown, depending on the details of the specific implementation. Furthermore, any of the functionalities of the workflow 100 may be partially, or entirely, implemented in hardware and/or in a processor. For example, the functionality may be implemented with an application specific integrated circuit, in logic implemented in a processor, in logic implemented in a specialized graphics processing unit, or in any other device.

Figure 6:
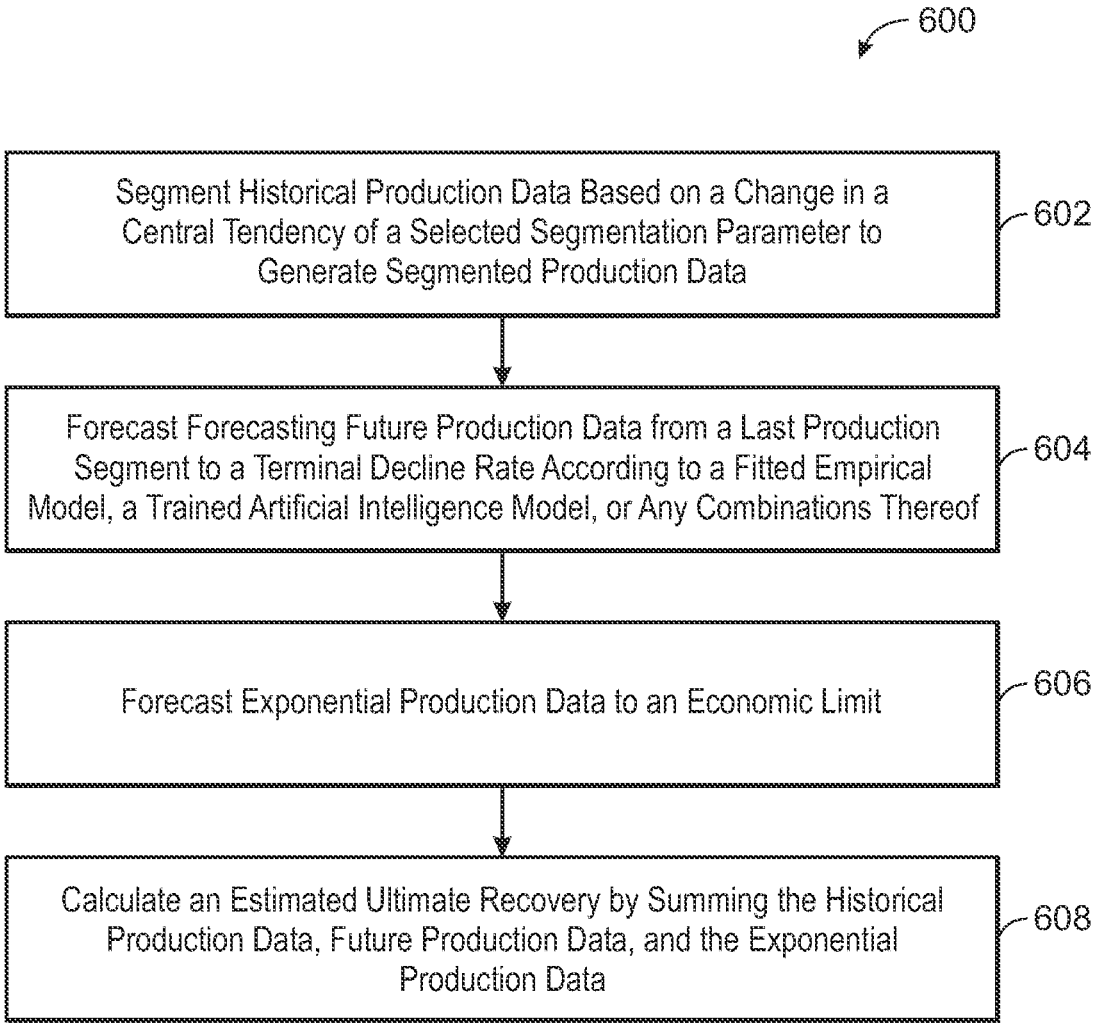
FIG. 6 is a process flow diagram of a process for automated decline curve and production analysis using automated production segmentation, empirical modeling, and artificial intelligence.

FIG. 6 is a process flow diagram of a process 600 for automated decline curve and production analysis using automated production segmentation, empirical modeling, and artificial intelligence. The process 600 may include the workflow 100 of FIG. 1. In embodiments, the process 600 is implemented using the controller 700 of FIG. 7.

At block 602, historical production data is segmented based on a change in a central tendency of a selected segmentation parameter to generate segmented production data.

At block 604, future production data is forecast from a last production segment to a terminal decline rate according to an empirical model or a trained artificial intelligence model. In some embodiments, the artificial intelligence models are pre-trained using transfer learning. In some embodiments, additional features that describe field performance are used to improve curve fitting for the artificial intelligence models.

At block 606, exponential production data is forecast to an economic limit.

At block 608, an estimated ultimate recovery is calculated by summing the historical production data, future production data, and the exponential production data.

The process flow diagram of FIG. 6 is not intended to indicate that the process 600 is to include all of the steps shown in FIG. 6. Rather, the process 600 can include fewer or additional elements not illustrated in FIG. 6 (for example, additional models, sensors, forecasts, data and the like). The process 600 of FIG. 6 may include any number of additional elements not shown, depending on the details of the specific implementation.

Figure 7:
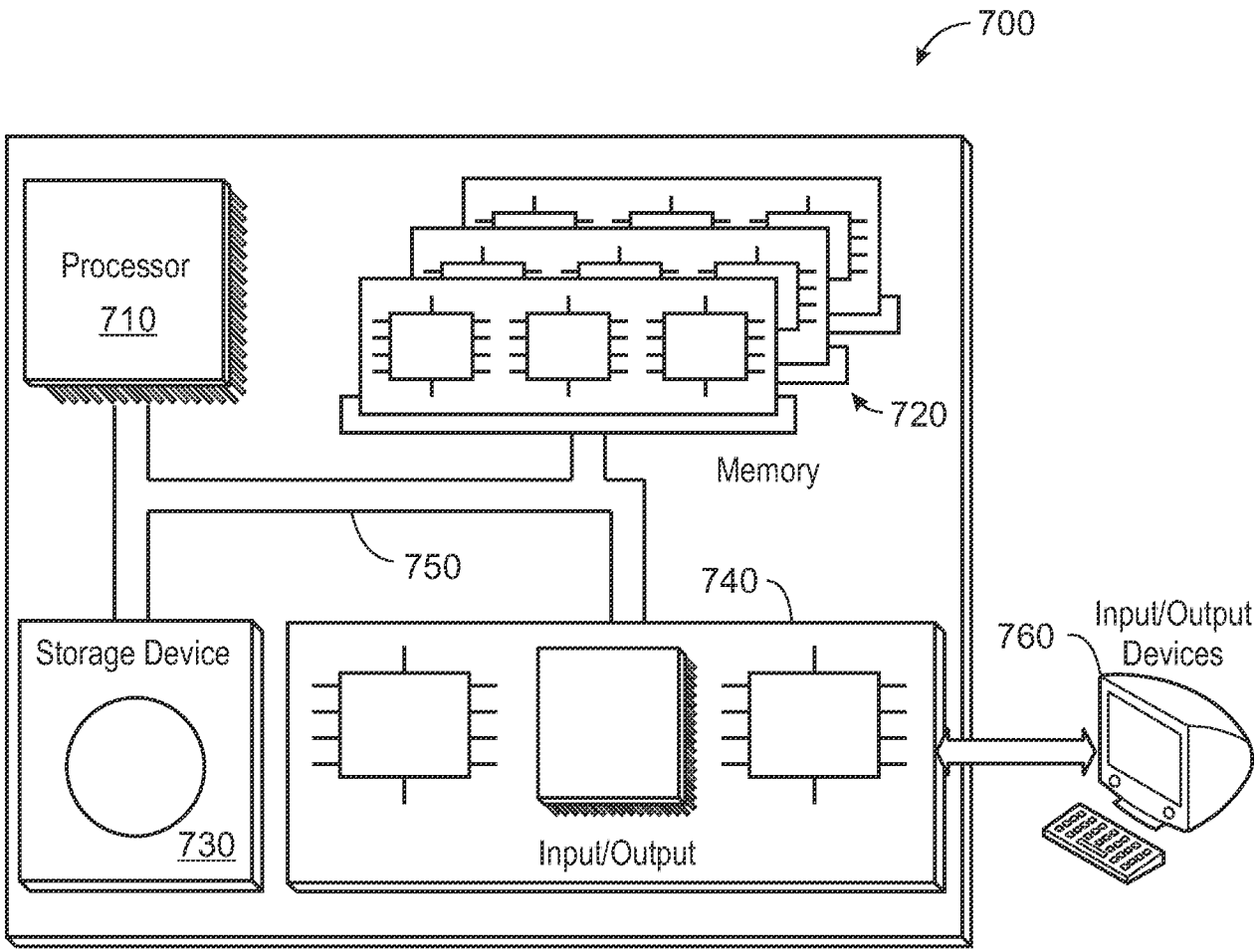
FIG. 7 is a schematic illustration of an example controller (or control system) for automated decline curve and production analysis using automated production segmentation, empirical modeling, and artificial intelligence.

FIG. 7 is a schematic illustration of an example controller 700 (or control system) for automated decline curve and production analysis using automated production segmentation, empirical modeling, and artificial intelligence according to the present disclosure. For example, the controller 700 may be operable according to the workflow 100 of FIG. 1 or the process 600 of FIG. 6. The controller 700 is intended to include various forms of digital computers, such as printed circuit boards (PCB), processors, digital circuitry, or otherwise parts of a system for automated decline curve analysis. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 700 includes a processor 710, a memory 720, a storage device 730, and an input/output interface 740 communicatively coupled with input/output devices 760 (for example, displays, keyboards, measurement devices, sensors, valves, pumps). Each of the components 710, 720, 730, and 740 are interconnected using a system bus 750. The processor 710 is capable of processing instructions for execution within the controller 700. The processor may be designed using any of a number of architectures. For example, the processor 710 may be a CISC (Complex Instruction Set Computers) processor, a RISC (Reduced Instruction Set Computer) processor, or a MISC (Minimal Instruction Set Computer) processor.

In one implementation, the processor 710 is a single-threaded processor. In another implementation, the processor 710 is a multi-threaded processor. The processor 710 is capable of processing instructions stored in the memory 720 or on the storage device 730 to display graphical information for a user interface via the input/output interface 740 at an input/output device 760.

The memory 720 stores information within the controller 700. In one implementation, the memory 720 is a computer-readable medium. In one implementation, the memory 720 is a volatile memory unit. In another implementation, the memory 720 is a nonvolatile memory unit.

The storage device 730 is capable of providing mass storage for the controller 700. In one implementation, the storage device 730 is a computer-readable medium. In various different implementations, the storage device 730 may be a floppy disk device, a hard disk device, an optical disk device, or a tape device.

The input/output interface 740 provides input/output operations for the controller 700. In one implementation, the input/output devices 760 includes a keyboard and/or pointing device. In another implementation, the input/output devices 760 includes a display unit for displaying graphical user interfaces. In embodiments, a user selects decline curve analysis using a fitted empirical model, trained artificial intelligence model, or any combinations thereof using a keyboard and/or pointing device, where the GUI is rendered via a display.

There can be any number of controllers 700 associated with, or external to, a computer system containing controller 700, with each controller 700 communicating over a network. Further, the terms "client," "user," and other appropriate terminology can be used interchangeably, as appropriate, without departing from the scope of the present disclosure. Moreover, the present disclosure contemplates that many users can use one controller 700 and one user can use multiple controllers 700.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship. Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method: a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

Particular embodiments of the subject matter have been described. Other embodiments are within the scope of the following claims. For example, the actions recited in the claims can be performed in a different order and still achieve desirable results. As one example, some processes depicted in the accompanying figures do not necessarily require the particular order shown, or sequential order, to achieve desirable results.

What is claimed is:

1. A computer-implemented method for automated decline curve and production analysis, the method comprising:

segmenting upscaled historical production data of a well within a reservoir system, wherein the historical production data is less than a day of sampling frequency, to generate segmented production data based on a change in a segmentation parameter, wherein upscaled historical production data is automatically segmented when a change in a maximum central tendency of windowed historical production data is outside of a flagged segmentation parameter change;

forecasting future production data from a last production segment to a terminal decline rate according to a fitted empirical model, a trained artificial intelligence model, or any combinations thereof using the segmented production data;

forecasting exponential production data to an economic limit using the segmented production data;

calculating an estimated ultimate recovery of the well by summing the historical production data, future production data, and the exponential production data; and detecting anomalies in production at the reservoir production system automatically, wherein production anomalies correspond to changes in the reservoir system that occur in the estimated ultimate recovery of the well.

2. The computer implemented method of claim 1, wherein the segmentation parameter is a well head pressure of the well.

3. The computer implemented method of claim 1, wherein the fitted empirical model is fit to the segmented production data by minimizing a difference between the segmented production data and predicted output of the fitted empirical model.

4. The computer implemented method of claim 1, wherein the trained artificial intelligence model is trained to predict a production decline of the well over time.

5. The computer implemented method of claim 1, wherein the exponential production data is forecast by an exponential model when the well reaches a terminal decline rate.

6. An apparatus comprising a non-transitory, computer readable, storage medium that stores instructions that, when executed by at least one processor, cause the at least one processor to perform operations comprising:

segmenting upscaled historical production data of a well within a reservoir system, wherein the historical production data is less than a day of sampling frequency, to generate segmented production data based on a change in a segmentation parameter, wherein upscaled historical production data is automatically segmented when a change in a maximum central tendency of windowed historical production data is outside of a flagged segmentation parameter change;

forecasting future production data from a last production segment to a terminal decline rate according to a fitted empirical model, a trained artificial intelligence model, or any combinations thereof using the segmented production data;

forecasting exponential production data to an economic limit using the segmented production data;

calculating an estimated ultimate recovery of the well by summing the historical production data, future production data, and the exponential production data; and detecting anomalies in production at the reservoir production system automatically, wherein production anomalies correspond to changes in the reservoir system that occur in the estimated ultimate recovery of the well.

7. The apparatus of claim 6, wherein the segmentation parameter is a well head pressure of the well.

8. The apparatus of claim 6, wherein the empirical model is fit to the segmented production data by minimizing a difference between the segmented production data and predicted output of the fitted empirical model.

9. The apparatus of claim 6, wherein the trained artificial intelligence model is trained to predict a production decline of the well over time.

10. The apparatus of claim 6, wherein the exponential production data is forecast by an exponential model when the well reaches a terminal decline rate.

11. A system, comprising:

one or more memory modules;

one or more hardware processors communicably coupled to the one or more memory modules, the one or more hardware processors configured to execute instructions stored on the one or more memory models to perform operations comprising:

segmenting upscaled historical production data of a well within a reservoir system, wherein the historical production data is less than a day of sampling frequency, to generate segmented production data based on a change in a segmentation parameter, wherein upscaled historical production data is automatically segmented when a change in a maximum central tendency of windowed historical production data is outside of a flagged segmentation parameter change;

forecasting future production data from a last production segment to a terminal decline rate according to a fitted empirical model, a trained artificial intelligence model, or any combinations thereof using the segmented production data;

forecasting exponential production data to an economic limit using the segmented production data;

calculating an estimated ultimate recovery of the well by summing the historical production data, future production data, and the exponential production data; and detecting anomalies in production at the reservoir production system automatically, wherein production anomalies correspond to changes in the reservoir system that occur in the estimated ultimate recovery of the well.

12. The system of claim 11, wherein the segmentation parameter is a well head pressure of the well.

13. The system of claim 11, wherein the empirical model is fit to the segmented production data by minimizing a difference between the segmented production data and predicted output of the fitted empirical model.

14. The system of claim 11, wherein the trained artificial intelligence model is trained to predict a production decline of the well over time.

15. The system of claim 11, wherein the exponential production data is forecast by an exponential model when the well reaches a terminal decline rate.

* * * * *